US006171198B1

(12) United States Patent
Lizama Troncoso et al.

(10) Patent No.: US 6,171,198 B1
(45) Date of Patent: Jan. 9, 2001

(54) MERRY-GO-ROUND FOR WHEEL CHAIRS

(75) Inventors: Mauricio Ambal Lizama Troncoso, Rio Piedras; David Serrano, San Juan; Eilleen Aviles, Coamo; Felix J. Santana Lopez, Jayuya; Victor M. Valentin, Trujillo Alto, all of PR (US)

(73) Assignee: University of Puerto Rico, Rio Piedras, PR (US)

( * ) Notice: Under 35 U.S.C. 154(b), the term of this patent shall be extended for 0 days.

(21) Appl. No.: 09/252,001

(22) Filed: Feb. 18, 1999

Related U.S. Application Data

(60) Provisional application No. 60/075,046, filed on Feb. 18, 1998.

(51) Int. Cl.[7] ..... A63B 1/48

(52) U.S. Cl. ..... 472/29; 472/35; 472/43

(58) Field of Search ..... 472/14, 21, 24, 472/29, 36, 43; 104/53; 14/69.5; 414/921, 537, 540, 543

(56) References Cited

U.S. PATENT DOCUMENTS

| | | | |
|---|---|---|---|
| 396,472 | 1/1889 | Duncan . | |
| 857,605 | 6/1907 | Dayton . | |
| 1,476,180 | 12/1923 | Reagen . | |
| 1,529,512 | 3/1925 | Smerechanski . | |
| 2,457,355 | 12/1948 | Dittmar . | |
| 2,533,368 | 12/1950 | Hansen et al. . | |
| 5,607,359 | 3/1997 | Framer, Sr. . | |
| 5,884,563 * | 3/1999 | Sheldon et al. | 104/53 |
| 5,935,011 * | 8/1999 | Morgan et al. | 472/29 |

FOREIGN PATENT DOCUMENTS

| | | | |
|---|---|---|---|
| 282419 * | 8/1952 | (CH) | 472/24 |

* cited by examiner

*Primary Examiner*—Kien T. Nguyen
(74) *Attorney, Agent, or Firm*—Patent Law Offices of Heath W. Hoglund

(57) ABSTRACT

A merry-go-round with a frame supported for rotation by a plurality of driven wheels, the merry-go-round having a space for a wheel chair and a space for a non-wheel chair bound person. Each separate space on the merry-go-round is associated with a respective crank assembly such that a person in that space can drive one of the driven wheels through a crank. A plurality of smaller wheels secured to the underside of the frame provide additional support for the merry-go-round. The person in the non-wheel chair bound space can stand on the frame, or in an alternate embodiment can sit on a chair. Because the merry-go-round has spaces for both wheel chairs and non-wheel chair bound people, both can use the merry-go-round at the same time.

38 Claims, 8 Drawing Sheets

MERRY-GO-ROUND FOR WHEEL CHAIRS

This application relies on the benefit of priority of U.S. provisional patent application Ser. No. 60/075,046, filed on Feb. 18, 1998, the entire disclosure of which is incorporated herein by reference.

BACKGROUND OF THE INVENTION

1. Field of the Invention

The present invention relates to a merry-go-round apparatus that can accommodate wheel chair bound users. Moreover, the present invention involves a merry-go-round apparatus that can also accommodate non-wheel chair bound users.

2. Background of the Related Art

Merry-go-rounds are generally known in the art for enjoyment by people of all ages, especially young children. Conventional merry-go-rounds employ a rotating structure supported at its center of rotation. Typically, a vertical post is secured in the ground, and a rotational bearing fixed to the merry-go-round rotates around the fixed post. Accordingly, most conventional merry-go-rounds revolve around a point fixed to the ground or some other structure. This structural arrangement renders it difficult to relocate most merry-go-rounds to an alternate location.

Very few, if any, merry-go-rounds are designed to accommodate handicapped individuals. In particular, merry-go-rounds typically lack structure for allowing wheel chair bound persons to occupy and propel the merry-go-round in a rotational direction. As such, most known merry-go-rounds are designed for use solely by non-handicapped children.

Some merry-go-rounds have chairs in which handicapped children could be strapped. Merry-go-rounds of this type, however, normally cannot be rotated by the users strapped to the seats. Rather, this type of merry-go-round is rotated by an individual who pushes the merry-go-round while standing or running next to it.

It is therefore an object of the present invention to provide for a merry-go-round having a number of practical advantages over conventional merry-go-rounds. For example, an object of the present invention is to provide a merry-go-round capable of being used on any selected flat, hard surface without the need for a fixed point of rotation.

Another exemplary object of the present invention is to provide a merry-go-round that can be used by handicapped people, and more specifically by people in a wheel chair. Yet another exemplary object of the present invention is to provide a merry-go-round that can be driven by wheel chair bound users alone or in combination with non-wheel chair bound users.

It should be understood that the invention could still be practiced without performing one or more of the preferred objects and/or advantages. Still other objects and/or advantages will become apparent after reading the following description of the invention.

SUMMARY OF THE INVENTION

The advantages and purposes of the invention will be set forth in part in the description which follows, and in part will be obvious from the description, or may be learned by practice of the invention. Moreover, the advantages and purposes of the invention will be realized and attained by means of the elements and combinations particularly pointed out in the appended claims.

Preferably, the present invention is directed to a merry-go-round apparatus that substantially obviates one or more of the limitations and disadvantages of the related art. To achieve these and other advantages and in accordance with the purposes of the present invention, as embodied and broadly described herein, one exemplary aspect of the invention comprises a merry-go-round including a rotatable platform defining at least one space for accommodating at least one individual in a wheel chair. A ramp is provided for loading in the space the individual in the wheel chair. In addition, the merry-go-round further includes at least one manually driven drive assembly for rotating the platform about an axis of rotation.

In another aspect, at least one ramp is provided for loading onto a rotatable support at least one individual on a wheel chair.

In an additional aspect, a plurality of wheels are coupled to the rotatable support to permit rotation of the rotatable support about an axis of rotation. Preferably, the manually driven drive assembly drives at least one of the wheels to thereby rotate the rotatable support about an axis of rotation.

In yet another aspect, first and second support members are provided on the rotatable platform. The first and second support members are spaced a sufficient distance apart from one another to place an individual in a wheel chair on the platform between the support members. At least one manually driven drive assembly is provided for driving at least one of the wheels to thereby rotate the rotatable platform about the axis of rotation. Preferably, the drive assembly comprises a movable drive actuator coupled to at least one of the first and second support members to permit movement of the actuator by arm movement of the individual in the wheel chair, and a transmission coupled between the moveable drive actuator and the at least one driven wheel.

In a further aspect, at least one wheel chair fastener movable between a wheel chair loading position and a wheel chair fastening position for selectively fastening the wheel chair to the platform when the fastener is in the wheel chair fastening position.

In an even further aspect, at least one passenger controlled drive assembly is provided.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention and are incorporated in and constitute a part of this specification. The drawings illustrate embodiments of the invention and, together with the description, serve to explain the principles of the invention. In the drawings.

DETAILED DESCRIPTION

Reference will now be made in detail to the present preferred embodiments of the invention illustrated in the accompanying drawings. Wherever possible, the same reference numbers are used throughout the drawings to refer to the same or like parts.

Figure 1:
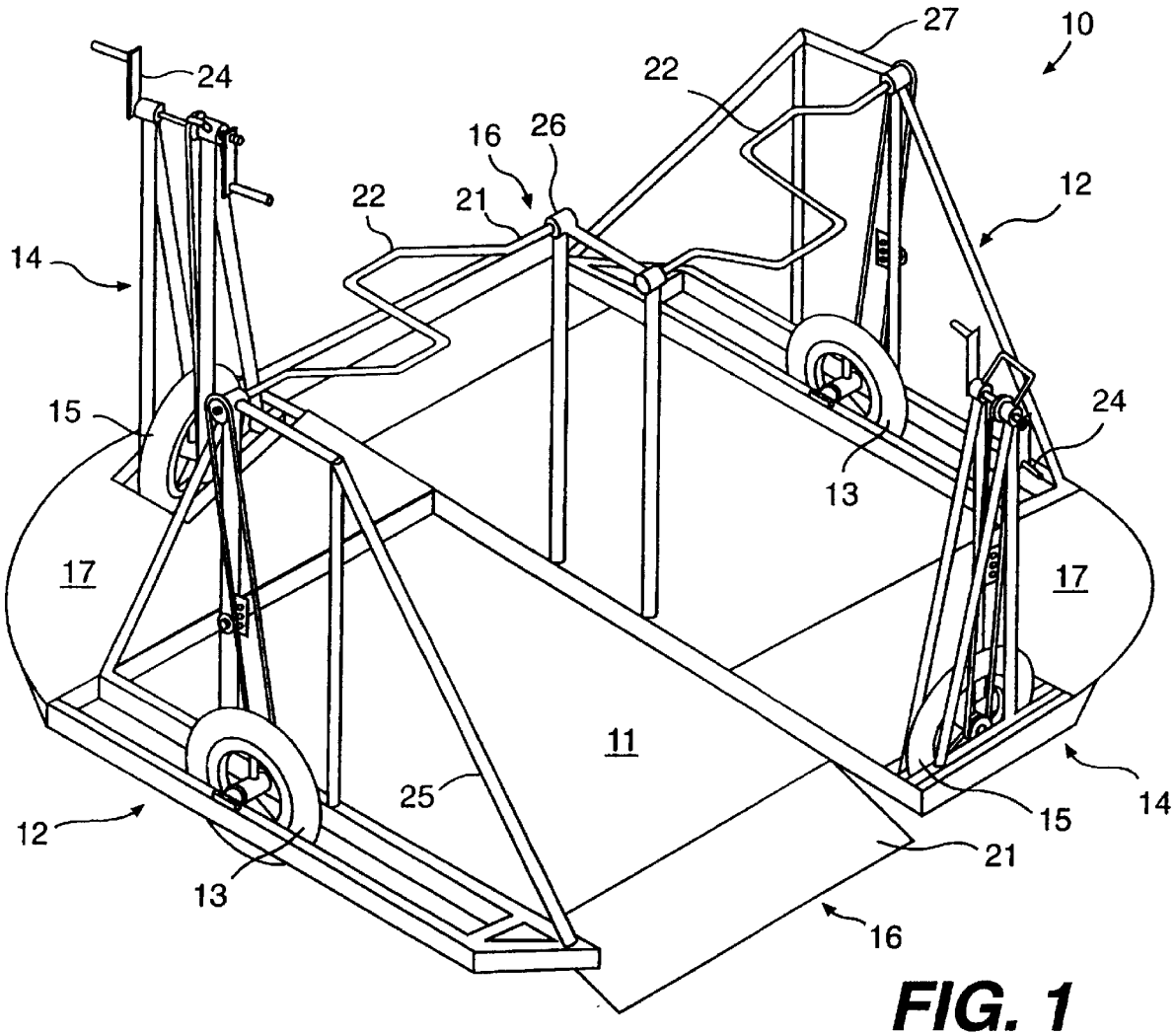
FIG. 1 is a perspective view of an embodiment of the merry-go-round of the present invention.
Figure 2:
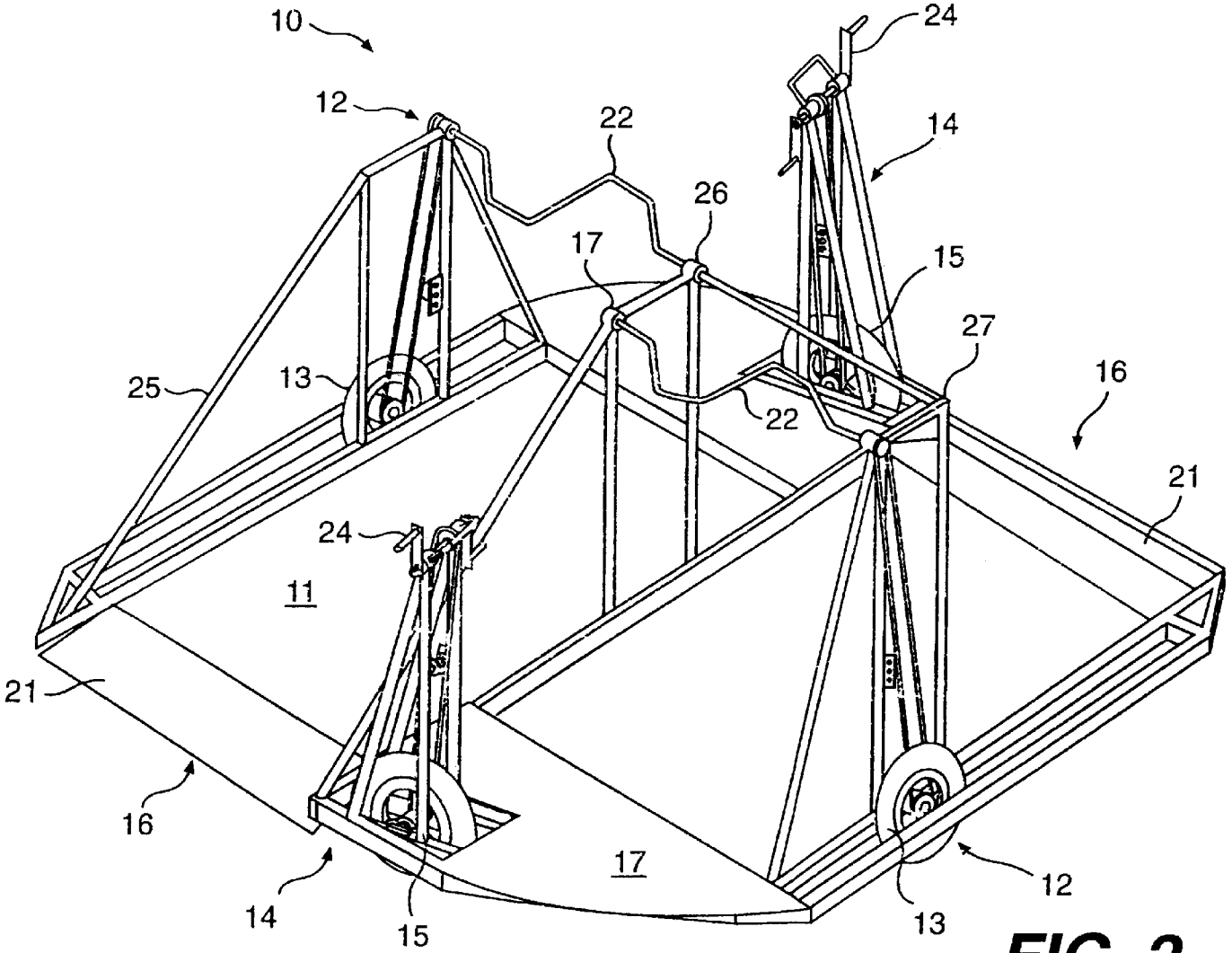
FIG. 2 is another perspective view of the embodiment of FIG. 1.

FIGS. 1 and 2 illustrate a exemplary embodiment of the merry-go-round (or ride) of the present invention identified generally with reference numeral 10. The merry-go-round 10 includes at least one support having a rotatable platform 11 that defines a pair of spaces or compartments 16 large enough to accommodate at least one individual in a wheel chair (not shown). The rotatable platform 11 also preferably defines a pair of spaces or compartments 17 each for accommodating at least one other individual (not shown), such as individuals standing at the respective spaces 17. The rotatable platform 11 itself can be comprised of either a single unitary component or a plurality of permanently or removably attached components (not shown).

The merry-go-round preferably also includes a pair of hinged ramps 21, drive assemblies 12 and 14, and vertical frame assemblies 25, 26, and 27. The hinged ramps 21, drive assemblies 12 and 14, and/or vertical frame assemblies 25, 26, and 27 are either attached directly to the platform 11 or coupled indirectly to the platform 11, such through any suitable intermediate connection. These elements may also be removably attached. Removable attachment may be achieved by screwing, snap-fitting or friction-fitting processes, for example. In contrast, a more permanent attachment may be achieved by molding, glueing or welding processes, for example.

Each of the spaces 16 and 17 is preferably defined by a respective portion of the platform 11 adjacent a respective drive assembly 12, 14. Preferably, the drive assembly 14 is configured to be driven by an individual standing at a respective space 17 and the drive assembly 12 is configured to be manually driven by an individual sitting on a chair (not shown) located in a respective one of the spaces 16. In a preferred embodiment, the ramps 21 are coupled to the platform adjacent to the spaced 16 to facilitate loading an individual in a wheel chair into each space 16. Preferably, the ramps 21 are coupled to the platform 11 via hinge members 32, shown in FIG. 4, for permitting the ramps 21 to pivot between a wheel chair loading position, shown in FIGS. 1 and 2 where a free end of each ramp is lower than the top surface of the platform 11, and a merry-go-round riding position (not shown) where each ramp 21 is substantially parallel with the platform 11, for example. In the wheel chair loading position, the top surface of the ramp 21 and the top surface of the platform 11 define an angle of about 14 degrees, for example.

Figure 3:
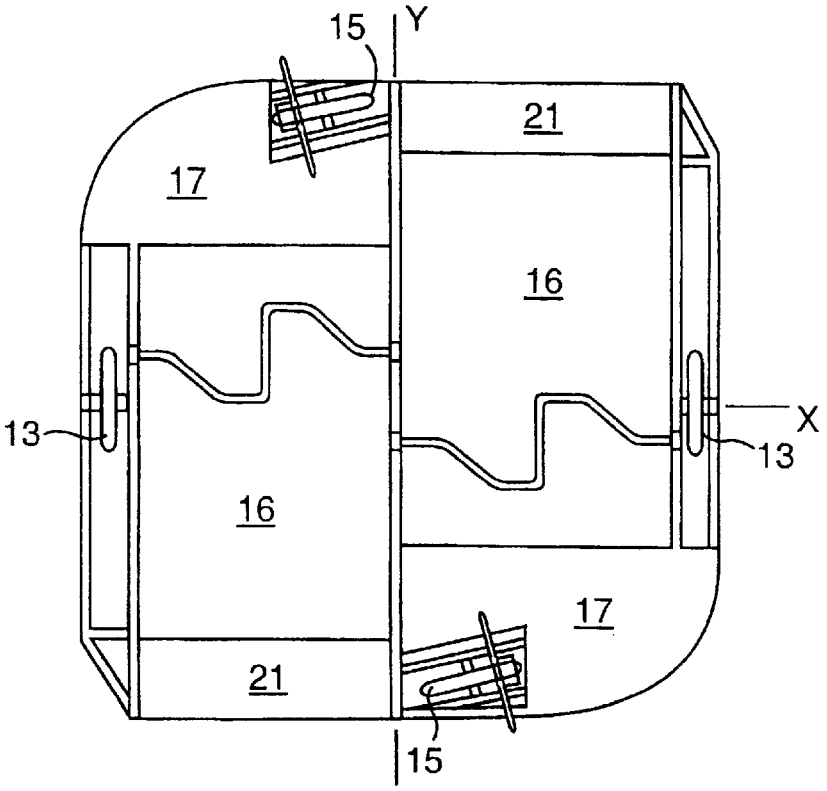
FIG. 3 is a top view of the embodiment of FIG. 1 showing two spaces for a wheel chair bound person and two spaces for a non-wheel chair bound person.

In the preferred embodiment, as shown in FIG. 3, the ride 10 also includes wheels 13 and 15 that are positioned such that their axes of rotation pass through the axis of rotation of the ride 10 itself. As illustrated in FIG. 3, the axis of rotation of each wheel 13 is aligned with an X axis. The axis of rotation of each wheel 15 is slightly offset from a Y axis perpendicular to the X axis when a portion of the wheels 13 and 15 project above the platform 11. This offset relationship positions each wheel 15 so as not to interfere with a wheel chair being driven into space 16 or over ramp 21. Accordingly, each wheel 15 is preferably positioned at a side of the entrance to the respective wheel chair space 17. For instance, FIG. 3 shows wheels 15 located such that the front of the wheel 15 is just behind (in the counterclockwise direction) the edge of the wheel chair space 16. Although the wheels 15 are preferably offset, the invention could still be practiced with other arrangements of the wheels 13 and 15.

Each of the drive assemblies 12 includes a respective crank mechanism (drive actuator) for driving a respective one of the wheels 13, and each of the drive assemblies 14 includes a respective crank mechanism (drive actuator) for driving a respective one of the wheels 15. As such, the preferred embodiment includes four wheels 13, 15 that are each driven by a respective drive assembly 12, 14. In the preferred embodiment, each of the wheels 13 can be driven by an individual located at a respective space 16. Likewise, each of the wheels 15 can be driven by a individual located at a respective space 17. Any number of drive assemblies 12 and 14 could be provided without departing from the invention.

As shown in FIGS. 1 and 2, crank mechanism 22 preferably extends across the entire width of the respective space 16 and is spaced a sufficient distance above the platform 11 to allow an individual in a wheel chair to ergonomically fit under each crank 22. This configuration allows each crank mechanism 22 to be rotated by arm movement of an individual in a wheel chair at a respective space 16.

Each crank mechanism 24 preferably is much smaller in width than the width of crank mechanism 22 and is preferably positioned above the platform at a distance sufficient to allow the crank mechanism 24 above the platform to be grasped by an individual standing at one of the spaces 17. Preferably, each crank mechanism is capable of being rotated by arm movement of an individual in space 17.

Although the drawings show the preferred arrangement of the drive asemblies 12 and 14, other configurations are possible. For example, one or more of the drive assemblies 12, 14 may include foot pedals (not shown) for allowing an individual to manually drive one or more wheels 13 and 15 via leg movement. In another alternative embodiment (not shown) one or more drive assemblies 12 and 14 is a passenger controlled drive assembly capable of being operated by individuals having different degrees of handicap. For example, an interactive electromechanical input control device, such as a manual switch and motor, could be used.

Figure 4:
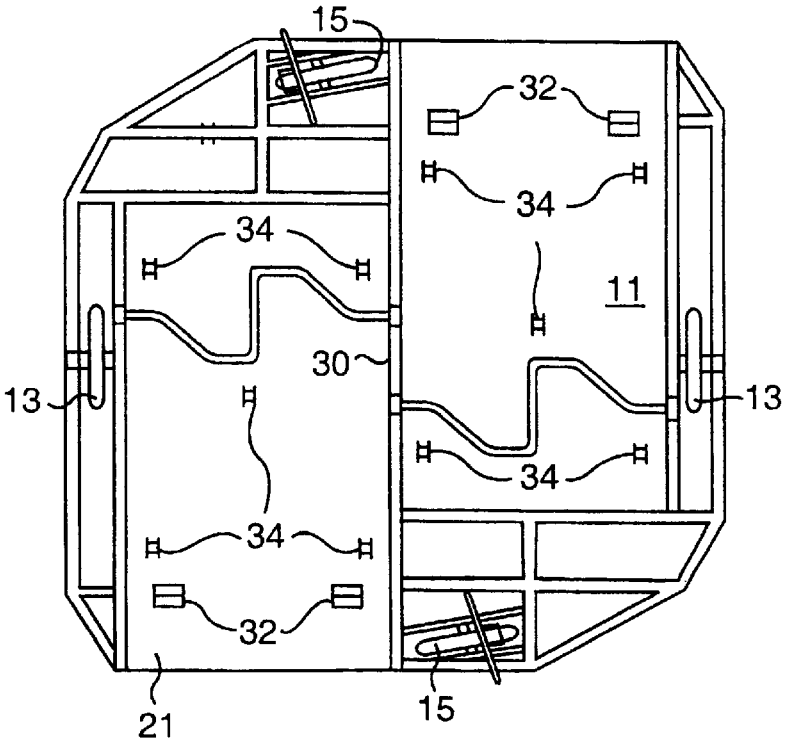
FIG. 4 is a partially cut-away similar to that of FIG. 3 showing the relative position of driven wheels and cranks that drive the wheels, and support wheels.

Preferably, the rotatable support of the merry-go-round 10 includes frame structure 30 for the ride 10 shown in FIG. 4. The frame structure 30 preferably includes a plurality of permanently or removably attached frame members made of hollow steel square tubing, or any other suitable material, secured together. The frame structure 30 preferably supports the driven wheels 13 and 15. In addition, the frame structure 30 supports the platform 11, which is preferably made of plywood panels to provide flooring over the wheel chair spaces 16 and the non-wheel chair spaces 17. The preferred height of the platform 11 relative to the surface on which the wheels 13 and 15 are placed is approximately 4–5 inches, for example.

In the illustrated embodiment, driven wheels 13 and 15 preferably have a diameter of about 12 inches, for example.

Preferably, driven wheels 13,15 are inflatable tires or have some other structure for providing sufficient cushioning support.

Figure 5:
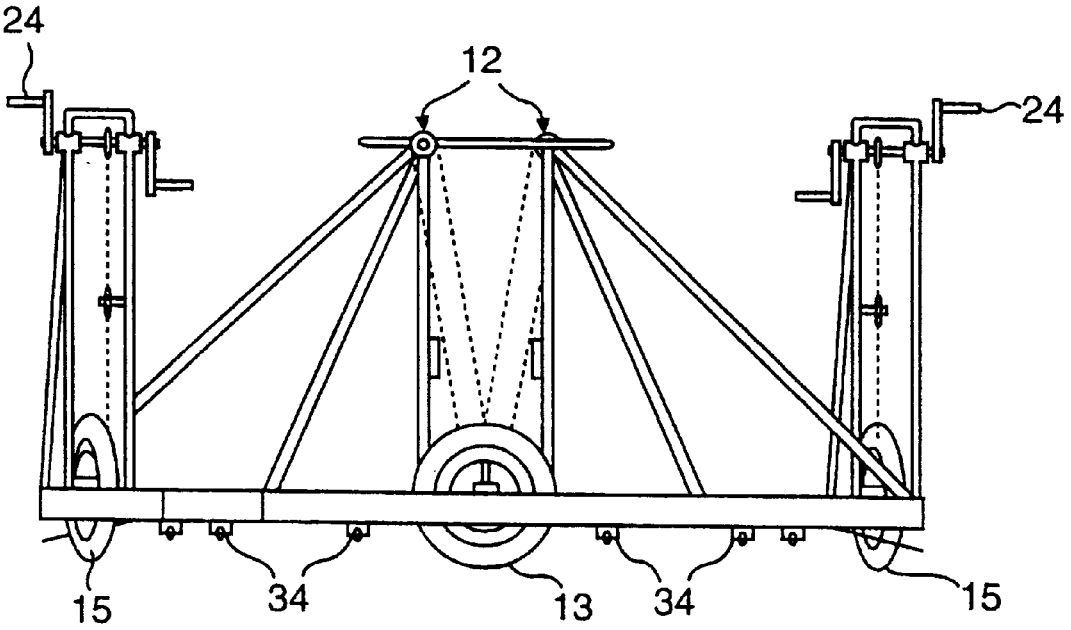
FIG. 5 is a side view of the embodiment of FIG. 1.

As shown in FIGS. 4 and 5, the support wheels 34, such as casters, are coupled to the support 11 to provide extra support. Preferably, the support wheels 34 are about 1½ inches in diameter, for example. Preferably, the support wheels 34 are located below corners of the spaces 16 and at the respective centers of the spaces 15 and 16. Bottom surfaces of the support wheels 14 are preferably located about ¼ inches above the bottom surface of wheels 13 and 15 so that the support wheels 34 do not normally contact the surface on which the merry-go-round 10 rotates. The driven wheels 13 and 15 and support wheels 34, permit the merry-go-round 10 itself to be moved to a plurality of different locations, and also permit riding of the merry-go-round at a number of different places.

Figure 7:
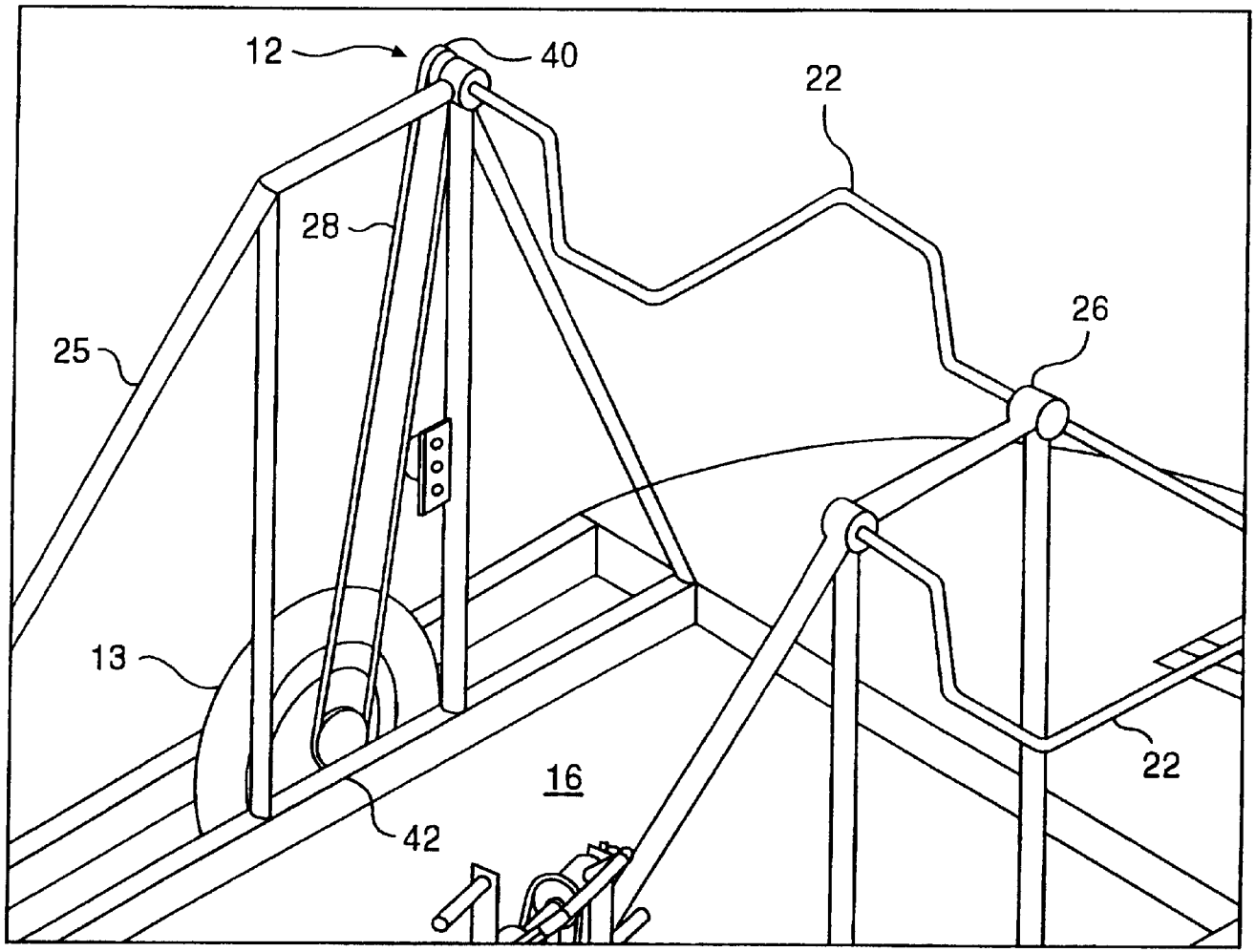
FIG. 7 is a detailed view of a crank assembly and a drive system for the wheel chair space of the embodiment of FIG. 1.
Figure 9:
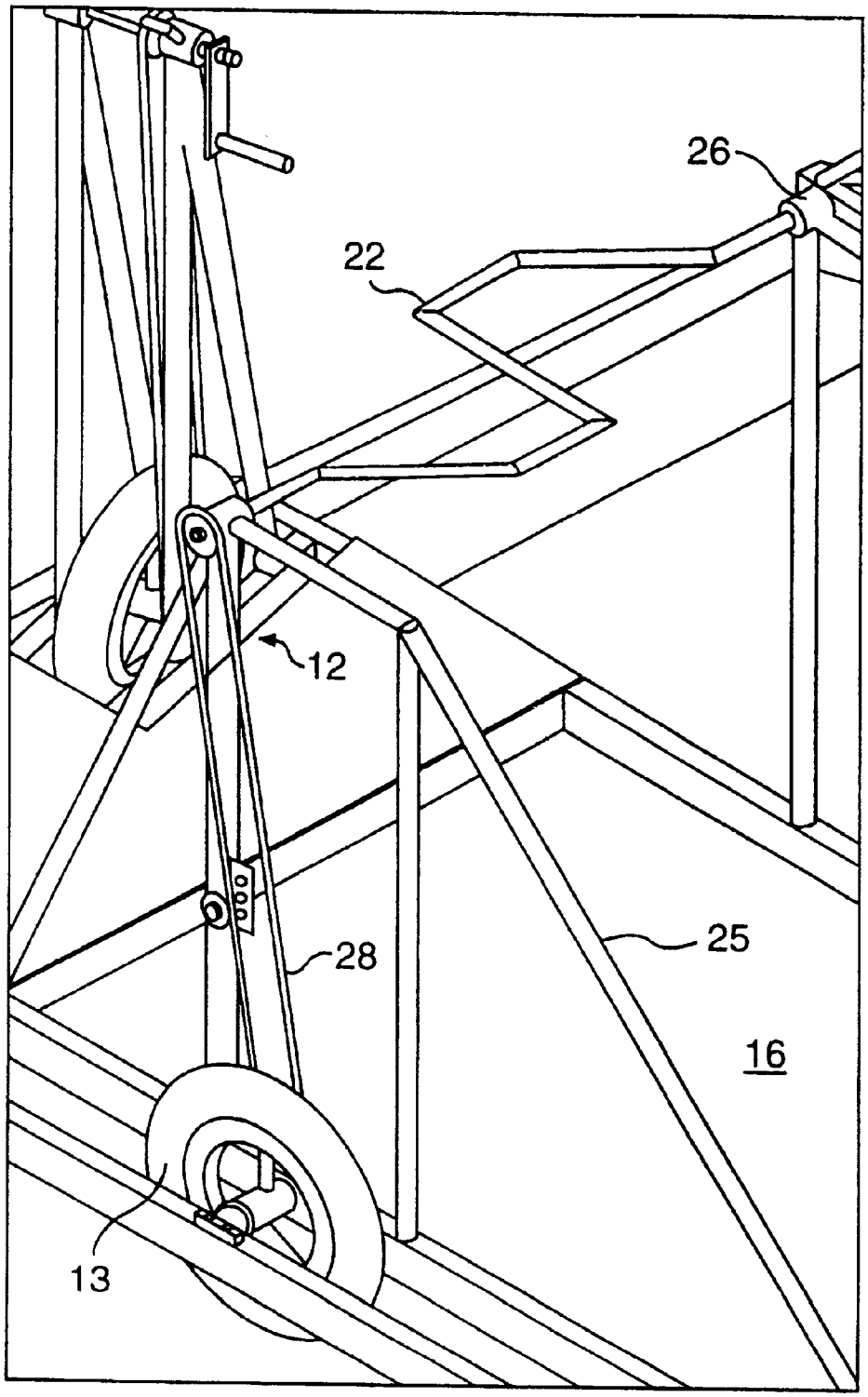
FIG. 9 is another detailed view of a crank and drive arrangement for the position occupied by a wheel chair.

FIGS. 7 and 9 illustrate the details of one of the drive assemblies 12 associated with space 16. The crank mechanism 22 is supported for rotation by a vertical frame assembly 25 located on one side of the crank mechanism 22, and a vertical frame assembly 26 located on another side of the crank mechanism 22. In a similar manner, the other crank mechanism 22 is supported between a vertical frame assembly 27, shown in FIG. 1 and the frame assembly 26. The frame assemblies 25, 26 and 27 are preferably spaced a sufficient distance apart from one another to allow a wheel chair to fit there between.

Preferably, bushings, or bearings, or similar structure are provided between the crank mechanisms 22 and frame assemblies 25–27 to reduce friction during rotation of the crank mechanisms 22.

As shown in FIG. 7, each drive assembly preferably includes a transmission comprising a drive sprocket 40 directly coupled to crank mechanism 22, a driven sprocket 42 directly coupled to a respective one of wheels 13, and a chain 28 engaged with the sprockets 40 and 42. Rotation of one of the cranks 22 drives the chain 28, which, in turn, rotatably drives a respective one of the wheels 13 to propel the merry-go-round 10 rotationally about its axis of rotation. Although the sprockets and associated chain are preferably employed, other structures, such as gearing arrangements alone or in combination with electromechanical devices, could be included.

Figure 6:
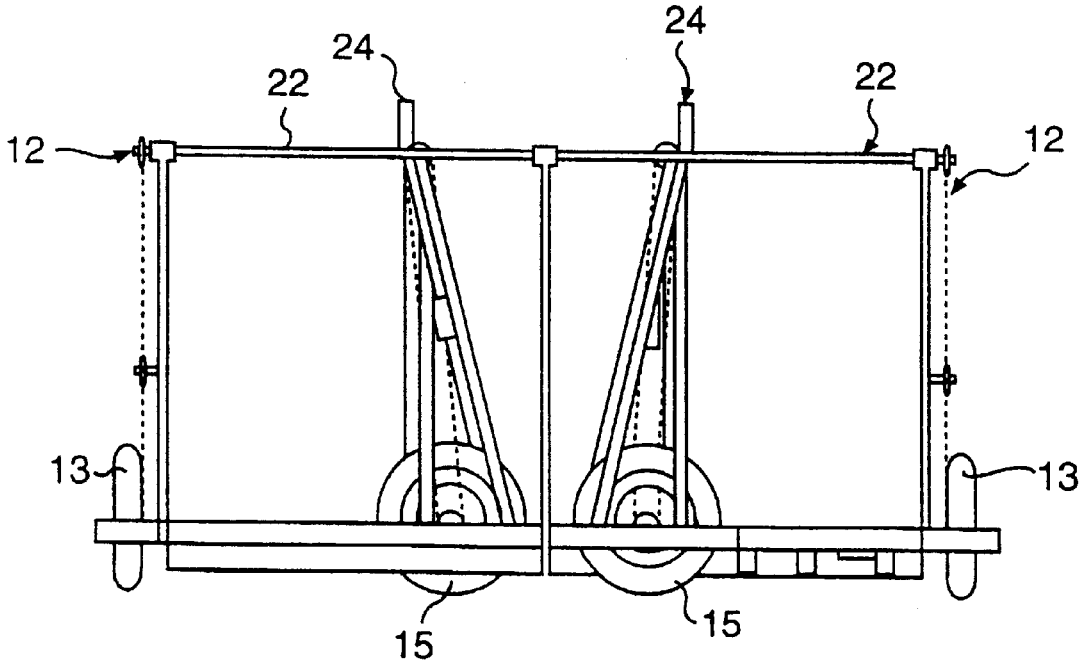
FIG. 6 is another side view of the embodiment of FIG. 1.
Figure 8:
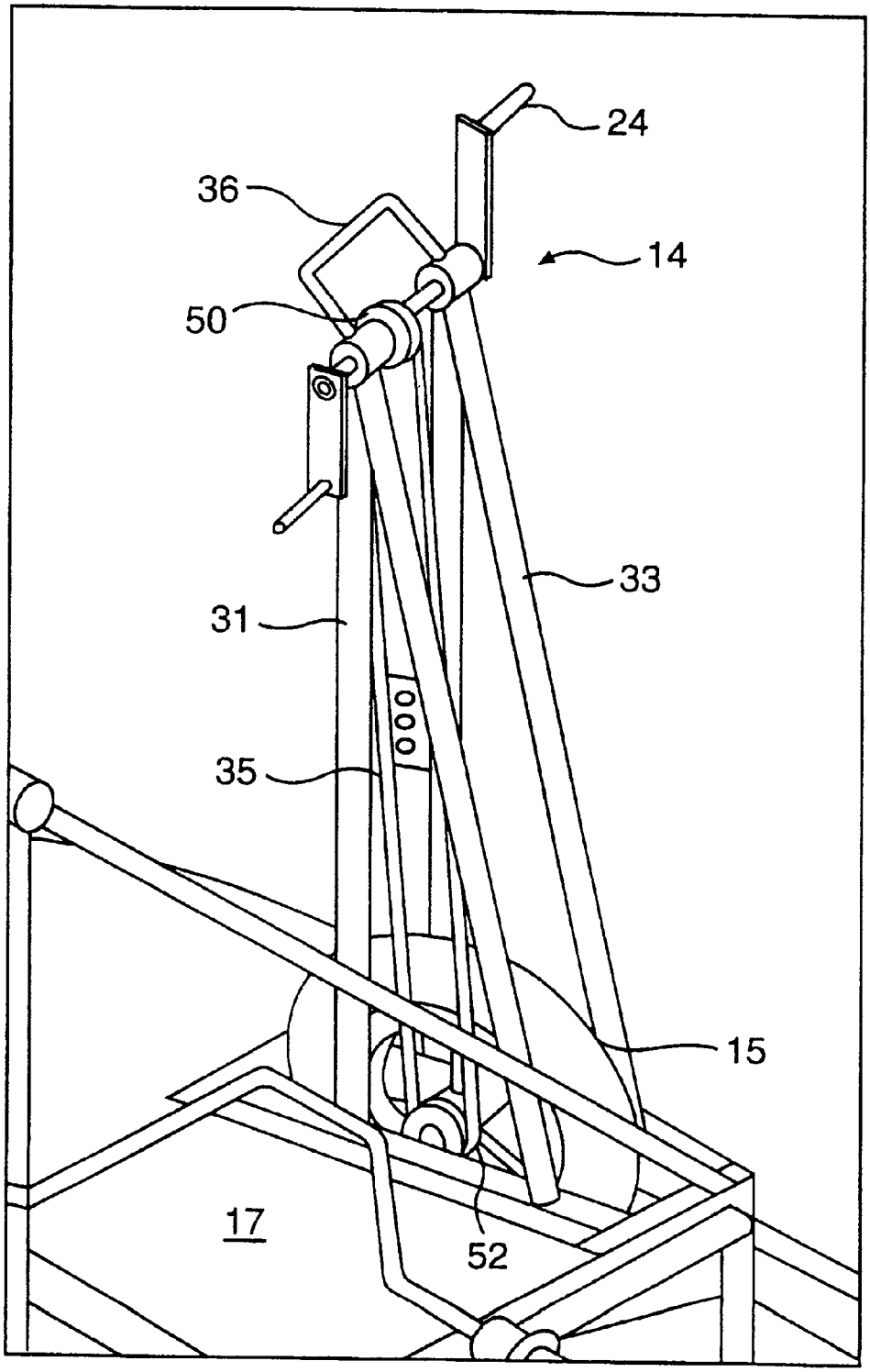
FIG. 8 is a detailed view a crank assembly and a drive system for a non-wheel chair space of the embodiment of FIG. 1.
Figure 10:
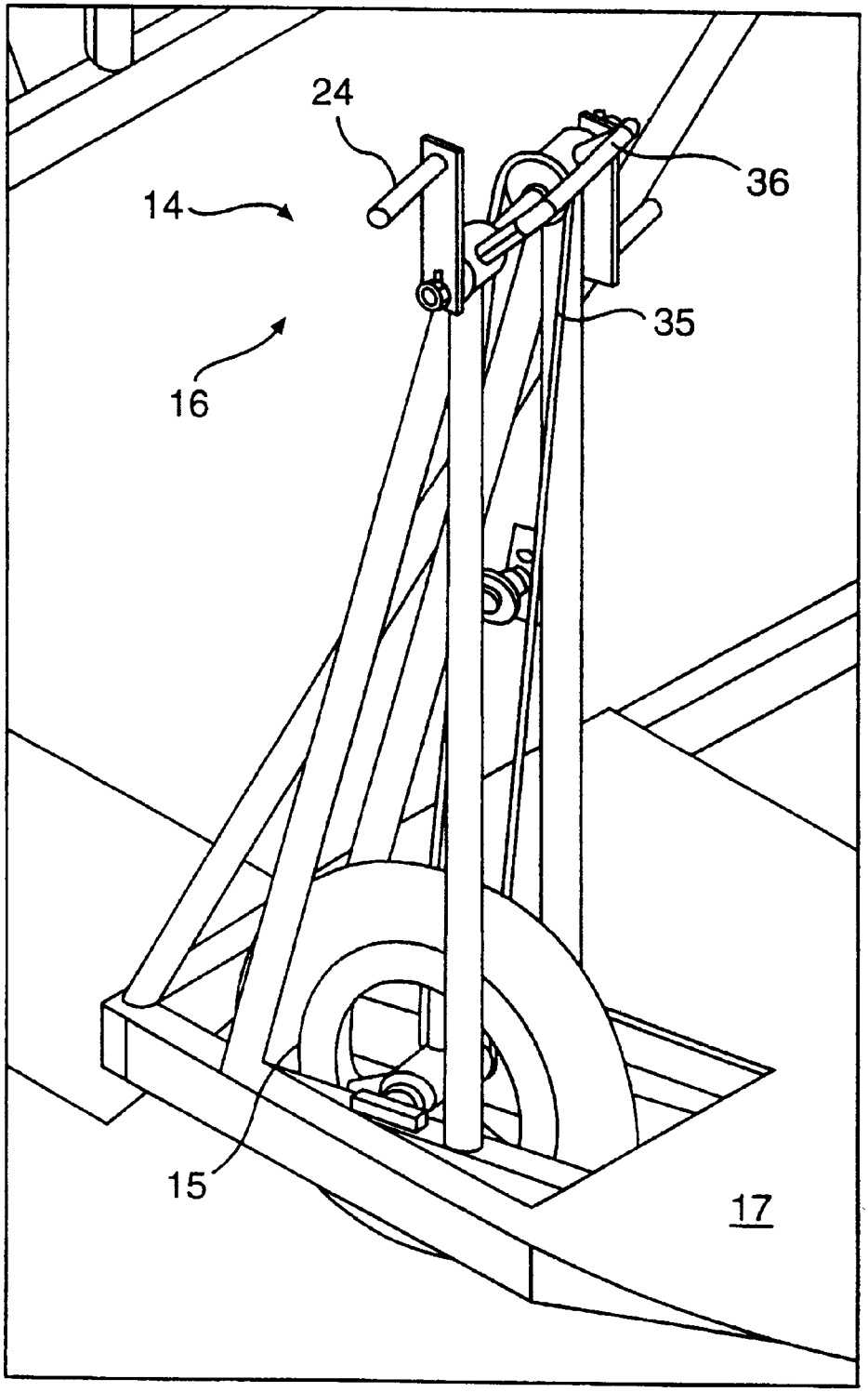
FIG. 10 is another detailed view of a crank and drive arrangement for the position occupied by a person standing in the non-wheel chair space.

FIGS. 8 and 10 illustrate the components of one of the drive assemblies 14 associated with a respective one of the spaces 17. The crank mechanism 24 of drive assembly 14 is supported by two vertical frame members 31 and 33, one on either side of the crank 24. Preferably, bushings, bearings, or the like are provided on the frame members 31 and 33 to reduce friction during rotation of crank 24. In the preferred embodiment, drive transmission is accomplished by employing a drive sprocket 50 (FIG. 6) directly coupled to the crank mechanism 24, a drive sprocket 52 directly coupled to a respective driven wheel 15, and a chain 35 engaging the sprockets 50 and 52. Thus, rotation of the crank mechanism 24 drives the chain 35, which, in turn, rotates the driven wheel 15 to propel the ride 10.

Preferably, each of the drive assemblies 12 and 14 includes a clutch assembly (not shown) that permits the crank 24, 26 to drive the chain 28, 35 during one direction of rotation of the crank 24, 26, and that allows for the crank 24, 26 to remain relatively motionless when wheels 13 and 15 are rotating and the ride 10 is in motion such that a person can hold the crank 24, 26 without it rotating. Moreover, for protection, a respective support arm 36 is preferably included above each of the cranks 24 as shown in FIGS. 8 and 10. The support arm 36 can be used by a person for support, or for protection from the crank 24, sprocket 50 and chain 35. In another preferred embodiment, one or more housings are provided for shielding the drive assemblies 12 and 14 for safety purposes.

In yet another alternative embodiment, suitable wheel chair fasteners can be utilized to selectively fix and/or lock a respective wheel chair in one of the spaces 16 and during the operation of the merry-go-round 10 itself. Selective fastening of a wheel chair may be achieved by, for example, resilient or rigid clamping, bracketing, screwing or snap-fitting selected parts of both a respective wheel chair and/or the merry-go-round 10 together. In the alternative, the ramp hinges 32, shown in FIG. 4, could be configured to permit the ramp 21 to pivot upwards above the top surface of platform 11, thereby blocking the entrance of the respective space 16 and securing a wheel chair in the space 16.

In operation, one to four people can use the ride 10 by driving the cranks 24, 26 associated with the respective space 16, 17 that an individual can occupy. A wheel chair can be loaded into one of the spaces 16 via a respective one of the ramps 21 and the individual therein can drive the crank 22 associated with that space 16. Similarly, an individual can stand on either of the spaces 16 or 17 and drive the associated crank 22, 24. The ride 10 is preferably capable of being used on any flat surface that will support the rotation of the wheels 13 and 15. Also, since the ride 10 is preferably not fixed to the ground at its center, as in other merry-go-rounds, the ride 10 can be portably transported to other locations. For example, the ride 10 can be used at an outdoor location during a sunny day, or at an indoor location during an inclement weather day.

It will be apparent to those skilled in the art that various modifications and variations can be made to the merry-go-round of the present invention without departing from the scope and spirit of the invention. For example, although the preferred merry-go-round 10 includes two spaces 16 for wheel chair bound users and two spaces 17 for non-wheel chair bound users, any number of spaces 16 and 17 can be used depending on the capabilities and size of the merry-go-round 10. As such, all of the spaces could be used for wheel chair bound users, or all of the spaces could be used for non-wheel chair bound users.

Other embodiments of the invention will be apparent to those skilled in the art from consideration of the specification and practice of the invention disclosed herein. It is intended that the specification and examples be considered as exemplary only. Thus, it should be understood that the invention is not limited to the illustrative examples in this specification. Rather, the invention is intended to cover all modifications and variations that come within the scope of the following claims and their equivalents.

We claim:

1. A merry-go-round comprising:

a rotatable platform defining at least one space for accommodating at least one individual on a wheel chair;

a ramp for loading in the space the individual on the wheel chair; and at least one manually driven drive assembly for rotating the platform about an axis of rotation.

2. The merry-go-round of claim 1, wherein the platform defines a first space for accommodating the at least one individual on the wheel chair and a second space for accommodating at least one other individual and wherein the drive assembly includes at least one rotatable crank positioned to permit rotation of the crank by at least one of the individuals.

3. The merry-go-round of claim 2, further comprising a plurality of wheels coupled to the platform to permit rotational movement of the platform on a surface.

4. The merry-go-round of claim 3, wherein at least one of the wheels is coupled to the crank to permit driving of the at least one wheel by rotation of the crank.

5. The merry-go-round of claim 4, wherein the drive assembly further comprises a first rotatable crank positioned to permit rotation of the first crank by the individual at the first space and a second rotatable crank positioned to permit rotation of the second crank by the individual at the second space.

6. The merry-go-round of claim 3, wherein the platform further defines a third space for accommodating another individual on a wheel chair and a fourth space for accommodating an additional individual.

7. A merry-go-round comprising:

a rotatable support having at least one ramp for loading onto the rotatable support at least one individual on a wheel chair, the rotatable support defining at least one space associated with the ramp for accommodating the individual on the wheel chair;

a plurality of wheels coupled to the rotatable support to permit rotation of the rotatable support about an axis of rotation; and at least one passenger controlled drive assembly for driving at least one of the wheels to thereby rotate the rotatable support about an axis of rotation.

8. The merry-go-round of claim 7, wherein the passenger controlled drive assembly comprises a rotatable crank positioned on the rotatable support to permit rotation of the crank by arm movement of the individual on the wheel chair and a transmission coupled to the rotatable crank to drive the at least one driven wheel in response to rotation of the crank.

9. The merry-go-round of claim 8, wherein the transmission comprises a chain and a plurality of rotatable sprockets for engaging the chain.

10. The merry-go-round of claim 8, wherein the rotatable support further comprises a platform and at least one frame on the platform, the rotatable crank being mounted on the frame so that the rotatable crank is above a wheel chair seat when the wheel chair is at the space on the rotatable support.

11. The merry-go-round of claim 7, wherein the rotatable support further defines at least one second space for accommodating at least one non-wheel chair bound individual.

12. The merry-go-round of claim 11, wherein the passenger controlled drive assembly comprises a rotatable crank positioned on the rotatable support to permit rotation of the crank by a individual at the second space and a transmission coupled to the rotatable crank to drive the at least one driven wheel in response to rotation of the crank.

13. The merry-go-round of claim 12, wherein the transmission comprises a chain and a plurality of rotatable sprockets for engaging the chain.

14. The merry-go-round of claim 12, wherein the rotatable support comprises a support arm adjacent to the crank, the support arm being capable of being grasped by the individual at the second space.

15. The merry-go-round of claim 12, wherein the rotatable support further comprises a platform and at least one frame on the plafform, the rotatable crank being mounted on the frame so that the crank is positioned above the platform at a height permitting rotation of the crank by arm movement of an individual on the platform at the second space.

16. The merry-go-round of claim 7, wherein the plurality of wheels comprise the at least one driven wheel and at least one supporting wheel.

17. The merry-go-round of claim 7, wherein the at least one driven wheel is offset such that the driven wheel does not interfere with the loading of the individual on the wheel chair.

18. The merry-go-round of claims 7, wherein at least some of the wheels rotate about a respective axis that intersects the axis of rotation of the rotatable support.

19. The merry-go-round of claim 7, wherein the rotatable support further comprises a hinge permitting movement of the ramp between a wheel chair loading position and a merry-go-round riding position.

20. The merry-go-round of claim 7, further comprising a seat on the rotatable support for allowing an individual to sit while riding the merry-go-round.

21. A merry-go-round comprising:

a rotatable platform;

a plurality of wheels coupled to the rotatable platform to permit rotation of the rotatable platform about an axis of rotation;

first and second support members on the rotatable platform, the first and second support members being spaced a sufficient distance apart from one another to place an individual on a wheel chair on the platform between the support members; and at least one manually driven drive assembly for driving at least one of the wheels to thereby rotate the rotatable platform about the axis of rotation, the drive assembly comprising a movable drive actuator coupled to at least one of the first and second support members to permit movement of the actuator by arm movement of the individual in the wheel chair, and a transmission coupled between the moveable drive actuator and the at least one driven wheel.

22. The merry-go-round of claim 21, wherein the moveable drive actuator is a crank rotatably coupled to the first and second support members.

23. A merry-go-round comprising:

a rotatable platform defining at least one space for accommodating at least one individual in a wheel chair;

at least one wheel chair fastener movable between a wheel chair loading position and a wheel chair fastening position for selectively fastening the wheel chair to the platform when the fastener is in the wheel chair fastening position; and at least one manually driven drive assembly for rotating the platform about an axis of rotation.

24. The merry-go-round of claim 23, wherein the fastener comprises a ramp for loading onto the rotatable platform at least one individual on a wheel chair and a hinge permitting movement of the ramp between the wheel chair loading position and the wheel chair fastening position.

25. A merry-go-round comprising:

a rotatable support having at least one ramp for loading onto the rotatable support at least one individual on a wheel chair, the rotatable support defining at least one space associated with the ramp for accommodating the individual on the wheel chair;

a plurality of wheels coupled to the rotatable support to permit rotation of the rotatable support about an axis of rotation; and at least one passenger controlled drive assembly for driving at least one of the wheels to thereby rotate the rotatable support about an axis of rotation.

26. A merry-go-round comprising:

a rotatable platform defining at least one compartment for accommodating at least one individual on a wheel chair; and a ramp for loading in the at least one compartment the individual on the wheel chair.

27. The merry-go-round of claim 26, wherein the platform defines a first compartment for accommodating the at least one individual on a wheel chair and a second compartment for accommodating at least one other individual.

28. The merry-go-round of claim 27, wherein the platform further defines a third compartment for accommodating another individual on a wheel chair and a fourth compartment for accommodating an additional individual.

29. The merry-go-round of claim 26, further comprising a plurality of wheels coupled to the platform to permit rotational movement of the platform on a surface.

30. The merry-go-round of claim 26, further comprising a ramp hinge permitting movement of the ramp between a wheel chair loading position and a merry-go-round riding position.

31. A merry-go-round comprising:

a rotatable support having at least one ramp for loading onto the rotatable support at least one individual on a wheel chair, the rotatable support defining at least one compartment associated with the ramp for accommodating the individual on the wheel chair; and a plurality of wheels coupled to the rotatable support to permit rotation of the rotatable support about an axis of rotation.

32. The merry-go-round of claim 31 wherein the rotatable support further defines at least one second compartment for accommodating at least one non-wheel chair bound individual.

33. The merry-go-round of claim 31, wherein the plurality of wheels comprise at least one driven wheel and at least one supporting wheel.

34. The merry-go-round of claim 33, wherein the at least one driven wheel is offset such that the driven wheel does not interfere with the loading of the individual on the wheel chair.

35. The merry-go-round of claim 31, wherein the rotatable support includes a hinge permitting movement of the ramp between a wheel chair loading position and a merry-go-round riding position.

36. The merry-go-round of claim 31, wherein the rotatable support comprises first and second support members on a rotatable platform, the first and second support members being spaced a sufficient distance apart from one another to place an individual on a wheel chair on the platform between the support members.

37. A merry-go-round comprising:

a rotatable platform defining at least one compartment for accommodating at least one individual in a wheel chair; and at least one wheel chair fastener movable between a wheel chair loading position and a wheel chair fastening position for selectively fastening the wheel chair to the platform when the fastener is in the wheel chair fastening position.

38. The merry-go-round of claim 37, wherein the fastener comprises a ramp for loading onto the rotatable platform at least one individual on a wheel chair and a hinge permitting movement of the ramp between the wheel chair loading position and the wheel chair fastening position.

* * * * *